United States Patent [19]

Ruskin

[11] Patent Number: 4,874,991

[45] Date of Patent: Oct. 17, 1989

[54] TOUCH CONTROLLED MULTIPLE POSITION LAMP

[76] Inventor: Thomas R. Ruskin, 85 E. India Row, Ste. 5F, Boston, Mass. 02110

[21] Appl. No.: 67,875

[22] Filed: Jun. 30, 1987

[51] Int. Cl.[4] ..... F21S 1/12

[52] U.S. Cl. ..... 315/362; 362/413; 362/414; 362/395; 362/424

[58] Field of Search ..... 362/395, 413, 414, 422, 362/424, 425, 220; 315/362

[56] References Cited

U.S. PATENT DOCUMENTS

| | | | |
|---|---|---|---|
| 3,694,647 | 9/1972 | Chapman, Jr. et al. | 240/81 |
| 3,715,623 | 2/1973 | Szabo | 315/194 |
| 3,955,079 | 5/1976 | Chapman et al. | 240/70 |
| 4,034,214 | 7/1977 | Chapman et al. | 240/70 |
| 4,101,805 | 7/1978 | Stone | 315/74 |
| 4,121,280 | 10/1978 | Chapman et al. | 362/418 |
| 4,238,818 | 12/1980 | Gindel | 362/413 |
| 4,390,933 | 6/1983 | Warshawsky | 362/413 X |
| 4,449,170 | 5/1984 | Warshawsky | 362/413 |
| 4,449,171 | 5/1984 | Warshawsky | 362/413 |
| 4,562,520 | 12/1985 | Chapman | 362/414 |
| 4,565,395 | 1/1986 | Rockwood et al. | 285/282 |
| 4,613,790 | 9/1986 | Roorda | 315/72 |

*Primary Examiner*—David K. Moore
*Assistant Examiner*—Mark R. Powell
*Attorney, Agent, or Firm*—Morse, Altman, Dacey & Benson

[57] ABSTRACT

The present invention provides a floor lamp of novel design in which a particular forwardly extending illuminator assembly is positioned above a particular forwardly extending base assembly by a particular telescoping tube assembly in association with a particular touch responsive electrical system. The arrangement is such that manually accessible parts of the base assembly, the illuminator assembly, and the telescoping tube assembly all are composed of metal, particularly brass or chrome plated metal. The designs of all of the these assemblies are consistent with the lamp's simplicity of construction, and communicate with each other electrically to permit touch switching of the DC electronic circuit that controls the AC electrical power input to the lamp.

18 Claims, 1 Drawing Sheet

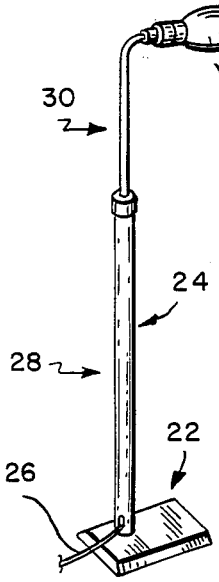
FIG. 1
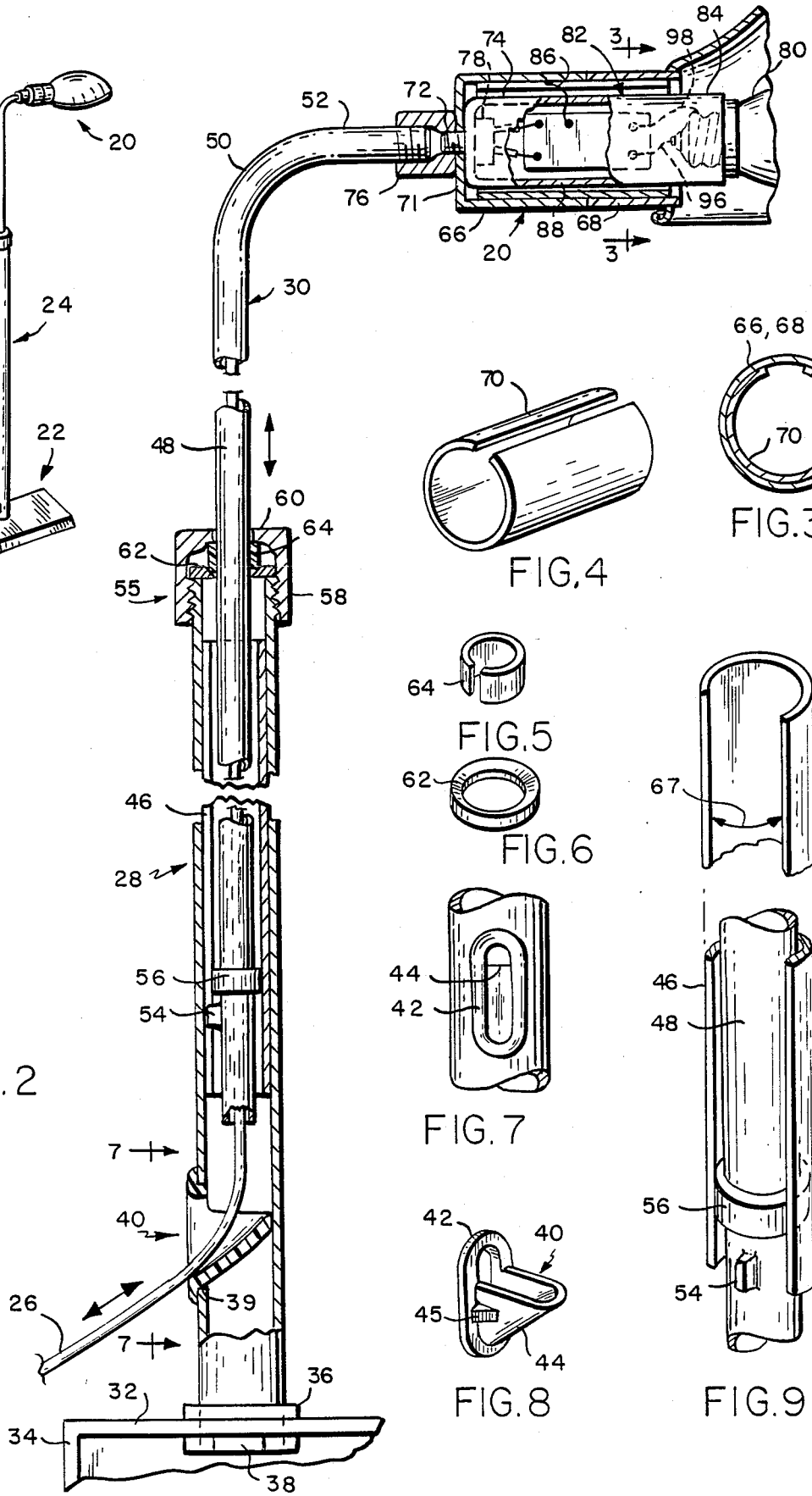
FIG. 2
FIG. 4
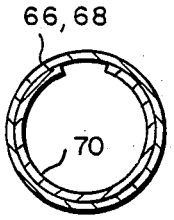
FIG. 3
FIG. 5
FIG. 6
FIG. 7
FIG. 8
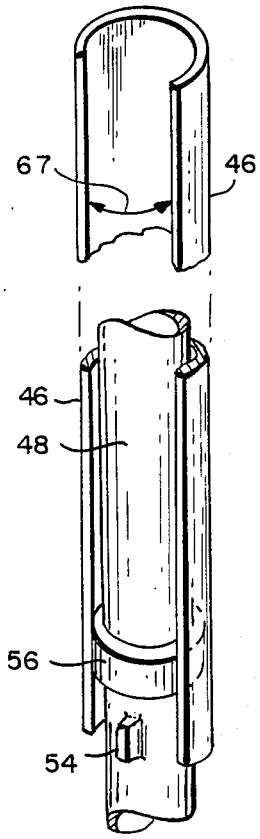
FIG. 9

TOUCH CONTROLLED MULTIPLE POSITION LAMP

BACKGROUND OF THE INVENTION

1. Field of the Invention

The present invention relates to decorative lighting units and, more particularly, to multiple position floor lamps. 2.

2. The Prior Art

There is a continuing need for improvement in the function and aesthetics of decorative floor lamps. There is a large market for floor lamps that provide greater convenience, coupled with simpler structure.

Floor lamps have been designed with an upper horizontally extending illuminator assembly, a lower horizontally extending base assembly and an upright telescoping tube assembly extending therebetween, by which the illuminator assembly is positioned above the base assembly at different extensible heights and different rotational orientations. Touch responsive sockets have been designed for receiving an electric light bulb and for controlling the power delivered to the light bulb in response to the touching of an electrically conductive part of the floor lamp. How best to combine such components to provide an improved touch responsive floor lamp has been a difficult problem.

SUMMARY OF THE INVENTION

The primary object of the present invention is to provide a floor lamp of novel design in which a particular forwardly extending illuminator assembly is positioned above a particular forwardly extending base assembly by a particular telescoping tube assembly in association with a particular touch responsive electrical system. The arrangement is such that manually accessible parts of the base assembly, the illuminator assembly, and the telescoping tube assembly all are composed of metal, particularly brass or chrome plated metal. The designs of all of the these assemblies are consistent with the lamp's simplicity of construction, and communicate with each other electrically to permit touch switching of the DC electronic circuit that controls the AC electrical power input to the lamp.

A more specific object of the present invention is to provide a floor lamp of the above type in which the following specific features are incorporated. The telescoping tube assembly includes a lower tube, an upper tube, and an inner tube, all composed of metal. The inner tube is split to provide a paraxial opening, which, in cross-section, has a solid sector that subtends an angle of at least 180 degrees and an open sector that subtends an angle of no greater than 180 degrees. The upper tube member has a vertical section that is adjustable within the lower tube in height along its axis and in orientation about its axis. A projection from the upper tube relatively adjacent to its lower end and relatively remote from its upper end extends into the open sector of the inner tube for setting limits on its orientation. A fixture is provided for locking the upper tube in height and orientation to the lower tube. The fixture includes a metal washer that deforms when the fixture is tightened to ensure locking of the upper tube and the lower tube. The upper tube has an elbow section and a substantially horizontal portion. The illuminator includes a mechanical mount and an electrical control. The mechanical mount includes an outer rearward barrel, an outer forward barrel, and an inner split tube press fitted within and extending into both of the barrels. The electrical control includes a housing rearwardly affixed to the rearward barrel, a forward socket for receiving a light bulb, and an electrical reactance for controlling the power delivered by the electrical control. An electrical power cord extends from outside of the floor lamp, through the lower tube, through the fixture, through the upper tube and to the electrical controller. The electrical reactance is responsive to manual contact of any part of the lamp when the upper tube is positioned by the fixture to the lower tube.

Other objects of the present invention will in part be obvious and will in part appear hereinafter.

The invention accordingly comprises the product, together with its parts and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description, taken in connection with the accompanying drawings, wherein, FIG. 1 is a perspective view of a floor lamp embodying the present invention;

FIG. 2 is a broken away mechanical view of the lamp of FIG. 1, sections thereof being shown in cross section along a vertical axis thereof, with certain electrical features being shown by diagrammatic electrical leads;

FIG. 3 is a cross-sectional view of the illuminator assembly, taken along the line 3–3 of FIG. 2;

FIG. 4 is a perspective view of a component of illuminator assembly;

FIG. 5 is a perspective view of a component of the fixture that locks the upper and lower tubes of the telescoping assembly;

FIG. 6 is a perspective view of another component of this fixture;

FIG. 7 is a front plan view of a part of the lower tube;

Fig. 8 is a perspective view of the part shown in FIG. 7; and

FIG. 9 is a broken away perspective view of parts of the upper and inner tubes.

DETAILED DESCRIPTION OF THE PREFERRED EMBODIMENT

The floor lamp of the illustrated embodiment of the present invention is shown in FIG. 1 as comprising an upper horizontally disposed illuminator assembly 20, a lower horizontally extending base assembly 22, and an upright telescoping tube assembly 24 extending therebetween. Illuminator assembly is powered by a standard dual electrical cord 26, which extends through telescoping tube assembly 24 and into illuminator assembly 20 in a manner now to be described.

As shown in FIG. 2, telescoping tube assembly 24 includes a lower tube 28 and an upper tube 30. Base 22 has a horizontal face portion 32 and a downwardly depending rim portion 34 that spaces the platform portion above the floor. Lower tube 28 is externally threaded at its lower end and extends through a bore in face portion 32. If is locked to the base by an internally threaded collar 36 which is turned onto the threaded end of the tube 28 face portion 32, and a nut 38 which is turned onto the threaded end of tube 28 below face portion 32 and tightened.

Adjacent to face portion 32 and in a wall of lower tube 28 is an opening 39 into which is snapped a plastic guide 40 for electrical cord 26. Guide 40, which per se is a component that is well known in the prior art, includes: a rim 42 that buts against the outer edge of opening 39; an inwardly and upwardly oblique ramp 44 that projects through opening 39 and extends to the opposite inner surface of the tube; and a pair of opposed lugs, one of which is shown at 45, which snap against and grip the inner edge of opening 39. Also within lower tube 28 is press fitted a slit inner tube 46, which serves a purpose that will be explained below.

In cross-section, slit inner tube 46 has a solid tubular perimeter that subtends an arc (in a plane perpendicular to the tubular axis) that is at least as great as 180 degrees, and an open gap that subtends an arc (in a plane perpendicular to the tubular axis) that is no greater than 180 degrees. Slit inner tube 46 has a normal diameter that is slightly larger than the diameter of lower tube 28 so that it firmly retains its position within the lower tube.

Upper tube 30 includes a downwardly depending portion 48, an elbow portion 50, and a horizontally extending portion 52. Adjacent the lower end of depending portion 48 is a key 54 that is stamped out of the wall of tubular portion 48 and extends into the opening of slit inner tube 46. A nylon collar 56 envelops tubular portion 48 and is retained within slit inner tube 46, its thickness being such as to position tubular portion 48 axially within slit tube 46.

At the upper end of lower tube 28 is a fixture 55, which includes an inverted metal cup 58, a metal washer 62, and a plastic, e.g. nylon, collar 64. Cup 58 is internally threaded and turned onto the upper threaded end of lower tube 28. The top of cup 58 has a central opening through which tubular portion 48 extends. Washer 62, which rests at the upper edge of lower tube 28, is compressed between the top of cup 58 and metallic washer 62. The inner periphery of washer 62 is bevelled, so that, when cup 58 is tightened, collar 64 is deformed so as to lock upper tube member 48 into any vertically adjusted raised or lowered position, and in any rotatably adjusted clockwise or counterclockwise position, as may be permitted by swivelling key 54 within the arcuate range shown at 67.

Illuminator assembly 20 includes a rearward barrel 66 and a forward barrel 68. The two barrels are adjustably retained, with their adjacent edges in substantial contact, by a spring metal split tube 70. Split tube 70 has a normal diameter that exceeds the diameter of barrels 66 and 68 so that when friction fitted into the barrels, it holds them firmly in adjusted relative orientation. Barrel 66 has has a centrally apertured base 71 through which projects a hollow screw fitting 72 which has a central bore and external threading. The extremity of horizontally extending portion 52 is externally threaded. Within rearward barrel 66 is a seat 74, which has a centrally apertured base that abuts against the base of rearward barrel 66 and through which extends screw fitting 72. The base of seat 74 and the base of rearward barrel 66 are clamped together and locked at the end of horizontally extending portion 52 by an external collar 76 and an internal collar 78. Internal collar 78 is internally threaded and turned onto the forward end of screw fitting 72. External collar 76 has a bore with different forward and rearward internal diameters. The forward end is internally threaded to receive the rearward end of screw fitting 72. The rearward end is internally threaded to receive the threaded extremity of horizontally extending portion 52.

An electric bulb 80 is mounted in and powered through a touch controlled sub-assembly generally shown at 82, which is mounted within illuminator assembly 20. Assembly 82 includes an elongated cylindrical housing 88, the rearward end of which is mounted on and fixed to seat 74 and the forward end of which is provided with a socket 84 for receiving bulb 80. Mounted within housing 88 is a printed circuit board assembly 90 that includes a silicon controlled rectifier. The firing angle of the silicon controlled rectifier is controlled in a four step sequence by any slight change of capacitance that is effected by manual touching of any outer metal surface of the lamp through an electrical connection, shown by way of example at 86, between the metal surface of the lamp and the gate of the silicon controlled rectifier. Power is supplied to the input terminals of the silicon controlled rectifier via the two electrical leads of insulated cord 26. Power is supplied to light bulb 80 by the silicon controlled rectifier via two electrical leads 96, 98 which are connected to the electrical terminals of the lamp socket. Touch responsive electrical controls of the type used in the combination of the present invention, per se, are old in the art and are disclosed in U.S. Pat. No. 4,613,790 in the name of John W. Roorda, U.S. Pat. No. 3,715,623 in the name of Szabo, and U.S. Pat. No. 4,101,805 in the name of Stone.

OPERATION

An important feature of the illustrated embodiment of the present invention is that virtually all external surfaces of the lamp are composed of electrically conducting metal, and all of these external surfaces are in electrical communication with each other and with the gate of the silicon controlled rectifier. In order for the firing angle of the silicon controlled rectifier to be responsive to any slight change of capacitance resulting from slight manual contact on any metallic surface of the lamp, it is necessary that there be an intimate electrical contact between upper tube 48 and lower tube 28, and between forward barrel 68 and rearward barrel 66, no matter what relative positions and orientations exist among these components. The required intimate electrical contact is achieved between upper tube 30 and lower tube 28 by fixture 55 when 2 cups 58 are tightened, although, in practice, the tolerances are sufficiently close so that the intimate electrical connections exist whether or not fixture 55 is tightened. The circumstances are such that, collar 60 bears upon plastic collar 64 to deform metal washer 62. When deformed, its outer region bears snugly against the upper free perimeter of lower tube 28 and its inner region bears against the periphery of upper tube 48. The required intimate electrical contact is achieved between forward barrel 68 and rearward barrel 66 by split tube 70 which bears against both. Adjustment of the orientation of illuminator assembly 20 is limited by key 54 and slit 67 of slit inner tube 46. Illuminator assembly 20 is provided with a reflector 100 that is soldered to forward barrel 68 so that its orientation can be adjusted manually via rotation of barrel 68 with respect to barrel 66 and so that manual contact with the reflector operates the gate of the silicon controlled rectifier.

What is claimed is:

1. A floor lamp comprising a base assembly, an illuminator assembly, and a telescoping tube assembly for positioning said illuminator assembly above said base assembly:

(a) said telescoping tube assembly including a lower tube, an upper tube, and an inner tube, all composed of metal, said lower tube, said upper tube and said inner tube being substantially coaxial;

(b) said inner tube being split to provide a paraxial opening, which, in cross-section, has a solid sector that subtends an angle of at least 180 degrees and an open sector that subtends an angle of no greater than 180 degrees;

(c) said upper tube having a vertical section that is adjustable within said lower tube in height along its axis and in orientation about its axis;

(d) a projection from said upper tube relatively adjacent to its lower end and relatively remote from its upper end extending into said open sector of the inner tube for setting limits on said orientation;

(e) a fixture for locking said upper tube in adjusted height and adjusted orientation to said lower tube;

(f) said illuminator assembly including an electrical control and a lamp socket;

(g) said electrical control being responsive to a change of reactance generated by manual contact with at least one of said base assembly, said telescoping tube assembly and said illuminator assembly; and (h) an electrical power cord extending from outside of the floor lamp, through the lower tube, through the fixture, through the upper tube and to the electrical control.

2. The floor lamp of claim 1 wherein said fixture includes a metal washer that deforms when the fixture is tightened to ensure locking of the upper tube and the lower tube.

3. The floor lamp of claim 1 wherein said upper tube has an elbow section and a substantially horizontal portion.

4. The floor lamp of claim 1 wherein said illuminator assembly includes a mechanical mount having an outer rearward barrel, an outer forward barrel, and an inner split tube press fitted within and extending into both of said barrels.

5. The floor lamp of claim 4 wherein said electrical control includes a housing rearwardly affixed to said rearward barrel, and a forward socket for receiving a light bulb.

6. The floor lamp of claim 5 wherein said electrical control includes a silicon controlled rectifier, the gate of which communicates electrically with said base assembly, said telescoping tube assembly, and said illuminator assembly.

7. The floor lamp of claim 6 wherein said gate is controlled by a change in electrical reactance that is caused by manual contact with at least one of said base assembly, said telescoping tube assembly, and said illuminator assembly.

8. A floor lamp comprising base means, illuminator means and telescoping means for mounting said illuminator means above said base means;

(a) said base means having an upper face and a rim depending therefrom;

(b) said telescoping means including a lower tube and an upper tube;

(c) the lower end of said lower tube being affixed to said base means;

(d) an inner tube within said lower tube, said inner tube being split to provide a paraxial opening;

(e) said inner tube, in cross-section, having a solid sector that subtends an angle of at least 180 degrees and an open sector that subtends an angle of no greater than 180 degrees;

(f) said upper tube having a vertical section that is adjustable within said lower tube in height along the axis thereof and in orientation about said axis thereof;

(g) a projection from said upper tube relatively adjacent to its lower end and relatively remote from its upper end, said projection extending into said open sector of said inner tube for setting limits on said orientation;

(h) a fixture for locking said upper tube in height and orientation to said lower tube, the upper end of said lower tube being externally threaded, said fixture including a deformable metallic washer seated at the upper end of said lower tube and having an opening through which said upper tube extends, an inner collar which rests on said metallic washer and through which said upper tube extends, and an outer cup having an internally threaded shank portion that is turned onto said externally threaded upper end of said lower tube and a centrally apertured base portion which bears against said internal collar and through which said upper tubular member extends;

(i) said upper tube having an elbow portion and a substantially horizontal portion;

(j) said illuminator assembly including electrical control means and mechanical mounting means;

(k) said mechanical mounting means including an outer rearward barrel, an outer forward barrel and an inner split tube that is press fitted within and extends into both said rearward barrel and said forward barrel;

(l) said electrical controll including an inner housing affixed to said rearward barrel, a forward socket for receiving a light bulb, and an electrical reactance for controlling the power delivered by said electrical control;

(m) an electrical power cord extending from outside of said floor lamp, through said lower tube, through said fixture, through said upper tube, and to said electrical control;

(m) said electrical reactance being responsive to manual contact of said base means, said telescoping means or said illuminator means when said upper tube is positioned with respect to said lower tube.

9. A floor lamp comprising base means, illuminator means, and telescoping tube means for positioning said illuminator means above said base means;

(a) said telescoping tube means including lower tube means, upper tube means, and inner tube means for limiting rotational orientation of said upper tube means with respect to said lower tube means, said lower tube means, said upper tube means and said inner tube means being substantially coaxial;

(b) at least some of the external surfaces of said base means, said illuminator means, and said telescoping tube means being composed of metal;

(f) said illuminator means including electrical control means and lamp socket means;

(g) said electrical control means being responsive to a change of reactance generated by manual contact with at least one of said external surfaces of said base means, said telescoping tube means and said illuminator means;

(h) electrical power cord means extending from outside of the floor lamp, through said lower tube means, through said inner tube means, through said upper tube means, and to said electrical control means;

[i] said inner tube means providing a paraxial opening, which, in cross-section, has a solid section that subtends a first angle and a solid sector that subtends a second angle;

[j] a projection from said upper tube extending into said open sector.

10. A floor lamp comprising base means, illuminator means, and telescoping tube means for positioning said illuminator means above said base means:

(a) said telescoping tube means including lower tube means, upper tube means, and limiting means for limiting rotational orientation and vertical reciprocation of said upper tube means with respect to said lower tube means;

(b) the external surfaces of said base means, said illuminator means, and said telescoping tube means being composed of metal;

(f) said illuminator means including electrical control means and lamp socket means;

(g) said electrical control means being responsive to a change of reactance generated by manual contact with said metal;

(h) an electrical power cord extending from outside of said floor lamp, through said lower tube means, through said limiting means, through said upper tube means, and to said electrical control means, (i) said limiting means including an inner tube means that is split to provide a paraxial opening, which, in cross-section, has a solid sector that subtends an angle of at least 180 degrees and an open sector that subtends an angle of no greater than 180 degrees;

(j) said upper tube means, said lower tube means and said inner tube means being substantially coaxial.

11. The floor lamp of claim 10 wherein said upper tube has a vertical section that is adjustable within said lower tube in height along its axis and in orientation about its axis, a projection from said vertical section relatively adjacent to its lower end and relatively remote from its upper end extending into said open sector of said inner tube for setting limits on said orientation.

12. The floor lamp of claim 11 wherein said limiting means includes inverted cup means and metal washer means, said inverted cup means locking said metal washer means in electrical contact with said upper tube and said lower tube.

13. The floor lamp of claim 12 wherein said upper tube has an elbow section and a substantially horizontal portion.

14. The floor lamp of claim 13 wherein said illuminator means includes a mechanical mount having an outer rearward barrel, an outer forward barrel, and an inner split tube press fitted within and extending into both of said barrels.

15. The floor lamp of claim 14 wherein said electrical control includes a housing rearwardly affixed to said rearward barrel, and a forward socket for receiving a light bulb.

16. The floor lamp of claim 15 wherein said electrical control includes a silicon controlled rectifier, the gate of which communicates electrically with said base means, said telescoping tube means, and said illuminator means.

17. The floor lamp of claim 16 wherein said gate is controlled by a change in electrical reactance that is caused by manual contact with at least one of said base means, said telescoping tube means, and said illuminator means.

18. The floor lamp of claim 17 wherein said limiting means helps to cause electrical communication among the conducting surfaces of said base means, said lower tube means, said upper tube means and said illuminator means.

* * * * *